US005269515A

United States Patent [19]

Chu

[11] Patent Number: 5,269,515

[45] Date of Patent: Dec. 14, 1993

[54] MACHINE FOR STRINGING GAME RACKET

[76] Inventor: David T. Chu, 150, Chung Chen Rd., Taichung, Taiwan

[21] Appl. No.: 52,533

[22] Filed: Apr. 29, 1993

[51] Int. Cl.[5] ..... A63B 51/14

[52] U.S. Cl. ..... 273/73 A; 273/73 B

[58] Field of Search ..... 273/73 R, 73 A, 73 B

[56] References Cited

U.S. PATENT DOCUMENTS

| | | | |
|---|---|---|---|
| 2,608,737 | 9/1952 | Serrano | 273/73 B |
| 3,823,609 | 7/1974 | Miyagawa | 273/73 A X |
| 4,373,721 | 2/1983 | Ray | 273/73 A |
| 4,376,535 | 3/1983 | Muselet et al. | 273/73 A |

FOREIGN PATENT DOCUMENTS

| | | | |
|---|---|---|---|
| 0382652 | 8/1990 | European Pat. Off. | 273/73 A |
| 3326261 | 1/1985 | Fed. Rep. of Germany | 273/73 A |
| 8705228 | 9/1987 | World Int. Prop. O. | 273/73 B |

*Primary Examiner*—William Stoll
*Attorney, Agent, or Firm*—Browdy and Neimark

[57] ABSTRACT

A game racket stringing machine comprises a machine body and a string-pulling gear. The machine body has a base comprising a main rod and two secondary rods which are pivoted respectively to the undersides of both ends of the main rod. The secondary rods can be rotated to overlap with the main rod so that the machine body can be reduced in volume. The string-holding gear comprises a rotatable wheel, two string-holding members, a tension rod, a weight fastened to the tension rod, and at least one elastic element which is disposed between the rotatable wheel and the string-holding members. The elastic element causes the string-holding members to move back to a specified position so as to release automatically the string which is held securely by the string-holding members.

6 Claims, 5 Drawing Sheets

MACHINE FOR STRINGING GAME RACKET

FIELD OF THE INVENTION

The present invention relates to a machine for stringing a game racket, and more particularly to a machine for stringing a game racket, which is provided with an improved string-pulling mechanism and an improved machine body so as to enhance the operational efficiency and the space utilization of the machine.

BACKGROUND OF THE INVENTION

As shown in FIG. 1, a string-pulling gear 10 of the prior art stringing machine comprises a rotatable wheel 11, a first string-holding member 12, a second string-holding member 13, a tension rod 16, and a weight 17. The rotatable wheel 11 is rotatably mounted to the body of the stringing machine. The first and the second string-holding members 12 and 13 are provided respectively on the circumferential surface thereof with a string groove 14. Both the first and the second string-holding members 12 and 13 are pivoted to one end of the rotatable wheel 11 such that the arresting faces 15 of the first and the second string-holding members 12 and 13 are spaced at a predetermined interval and are opposite to each other. The tension rod 16 is fastened at one end thereof to the rotatable wheel 11. The weight 17 is fitted over the tension rod 16 so that the tension rod 16 is provided with the needed force of gravity acting thereon.

In operation, a game racket frame to be strung is held securely on the machine body in such a manner that a string 18 is put through a string hole of the game racket frame before the string 18 is wound in the string grooves 14 of the first and the second string-holding members 12 and 13. Thereafter, the string 18 is put between the arresting faces 15 of the first and the second string-holding members 12 and 13, as shown in FIG. 2. The string 18 can be tightened up by swiveling the tension rod 16. As soon as the rotatable wheel 11 begins turning, the first and the second string-holding members 12 and 13 are acted on by a force of counteraction by the string 18 so that the first and the second string-holding members 12 and 13 bring about respectively an angular displacement relative to the rotatable wheel 11, as shown in FIG. 3. Such angular displacement persists until such time when the string 18 is held securely by the two arresting faces 15 of the first and the second string-holding members 12 and 13. As soon as the angular displacements of the first and the second string-holding members 12 and 13 cease, the first and the second string-holding members 12 and 13 can rotate synchronously along with the rotatable wheel 11 so as to ensure that the string 18 is tightened with certainty.

The prior art stringing machine described above has shortcomings, which are elucidated hereinafter.

The string 18 is tightened up by means of the tension rod 16 which is acted on by the gravitational force of the weight 17. The tension rod 16 can exert a specific quantity of tension as required on the string 18 only under the circumstance that the tension rod 16 is caused to swivel to locate within an angular range of 5 degrees over a horizontal line and within another angular range of 5 degrees under the horizontal line, as shown in FIG. 4. Otherwise, the tension rod 16 can exert an erroneous quantity of tension on the string 18. Therefore, the string 18 must be rewound on the string-holding members 12 and 13. As shown in FIG. 5, in the course of rewinding the string 18, the tension rod 16 is caused to swivel in reverse. In the meantime, the first and the second string-holding members 12 and 13 are exerted on by a residual tension force of the string 18. As a result, the string 18 is still held securely by the two arresting faces 15 of the first and the second string-holding members 12 and 13. The operator of the stringing machine is therefore required to use his or her hands to move the arresting faces 15 apart so as to release the string 18. It is apparent that the prior art stringing machine can be often a source of aggravation as far as the machine operator is concerned.

In addition, the prior art stringing machine is so cumbersome that it takes up too much of the floor space and that it can not be easily packed, transported, and stored.

SUMMARY OF THE INVENTION

It is therefore the primary objective of the present invention to provide a machine for stringing a game racket, which has an improved string-pulling mechanism capable of enhancing the operational efficiency of the machine.

It is another objective of the present invention to provide a game racket stringing machine, which has a compact body and can be therefore packed, transported, and stored easily.

In keeping with the principles of the present invention, the foregoing objectives of the present invention are attained by a racket stringing machine, which comprises mainly a body and a string pulling mechanism. The string pulling mechanism is composed of a rotatable wheel, two string-holding members, a tension rod, and a weight. The rotatable wheel is mounted rotatably on the body. Each of the two string-holding members has an arresting face and a circumferential surface which is connected with the arresting face and provided with a string groove. The two string-holding members are pivoted to one end of the rotatable wheel in such a manner that their arresting faces are spaced at a predetermined interval and opposite to each other, and that the two string-holding members can be angularly displaced by an external force acting on the rotatable wheel, so as to cause the arresting faces to stay close together. The tension rod is fastened to the rotatable wheel which can be caused to turn by the swiveling of the tension rod to which the weight is attached. The string-pulling mechanism is characterized in that it further comprises at least an elastic element, which is mounted between the rotatable wheel and the two string-holding members for the purpose of providing the two string-holding members with an elastic bouncing force enabling the string-holding members to move back to a specified position so as to keep the arresting f aces apart. As a result, the two string-holding members can be caused to release automatically the string which is held securely by the arresting faces when the machine operator is rewinding the string on the string-holding members.

The racket stringing machine of the present invention is further characterized in that its body has a base comprising a main rod and two secondary rods which are pivoted respectively to the undersides of the both ends of the main rod. As a result, the body of the racket stringing machine of the present invention can be so downsized that the machine can be easily packed, transported, and stored.

The foregoing objectives, features and functions of the present invention can be better understood by studying the following detailed description of the present invention, in conjunction with the accompanying drawings.

DETAILED DESCRIPTION OF THE INVENTION

Figure 6:
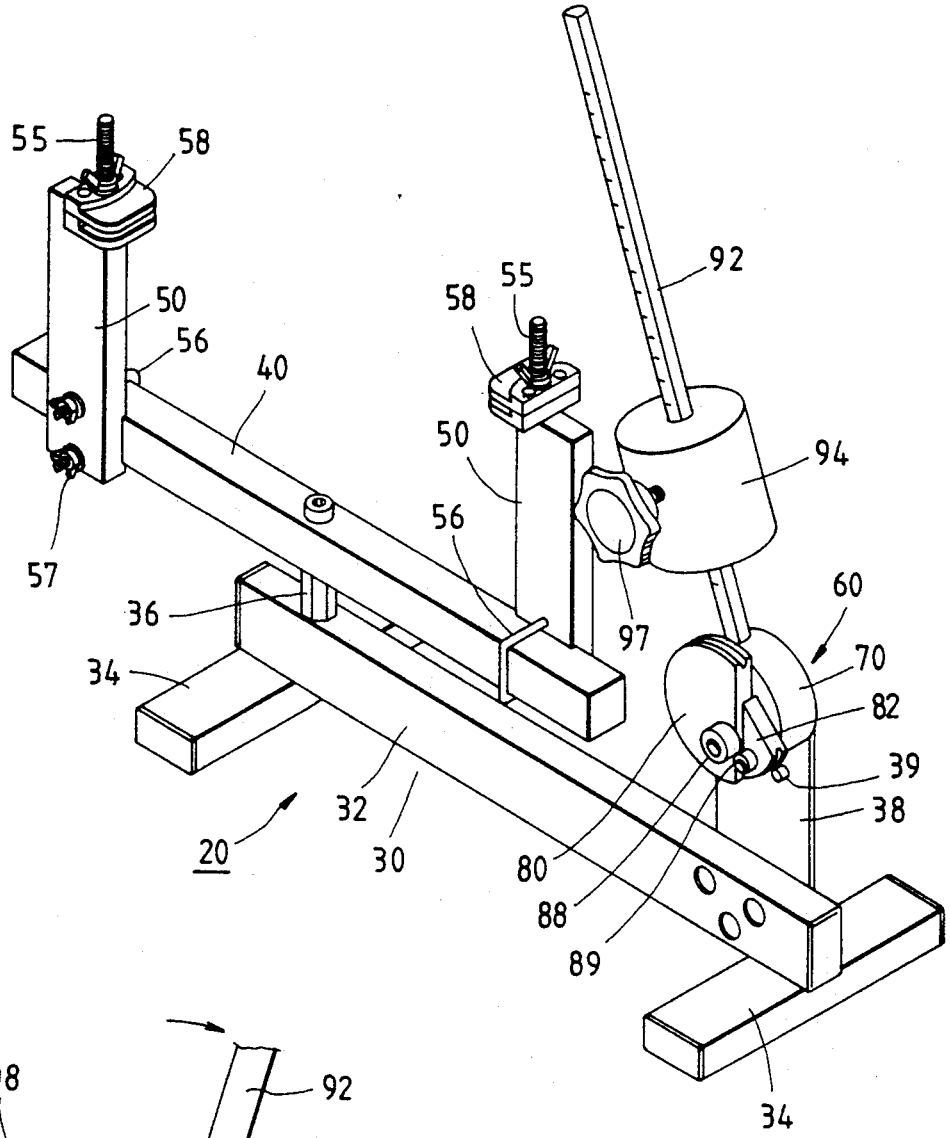
FIG. 6 shows a perspective view of a game racket stringing machine of the present invention.
Figure 7:
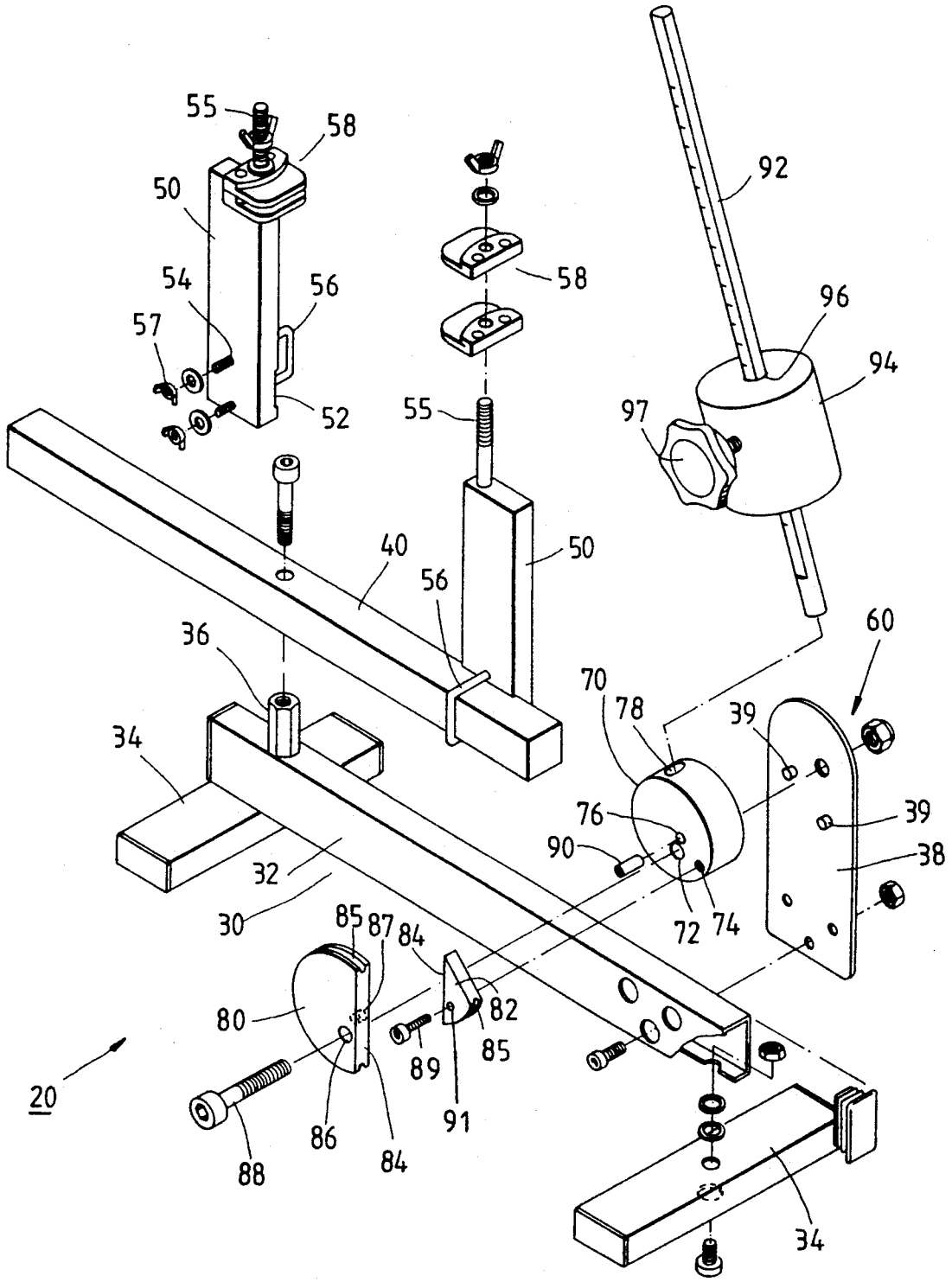
FIG. 7 shows an exploded view of the game racket stringing machine as shown in FIG. 6.

Referring to FIGS. 6 and 7, a game racket stringing machine 20 of the present invention is shown to comprise mainly a machine body 22 and a string-pulling gear 60 mounted on the machine body 22.

The machine body 22 comprises a base 30, a guide rod 40, two arms 50, and two clamping members 58. The base 30 has a main rod 32 and two secondary rods 34 which are pivoted respectively to the undersides of the two ends of the main rod 32 by means of nuts, bolts and washers. The secondary rods 34 can be rotated in relation to the main rod 32, which is further provided thereon with an upright columnar portion 36. The guide rod 40 is pivoted to the base 30 by means of a bolt engageable with a threaded hole of the columnar portion 36. The two arms 50 are fastened respectively to both ends of the guide rod 40. Each of the two arms 50 is provided at the bottom edge of one side thereof with an insertion slot 52 having two through holes 54 located respectively at the upper and the lower sides thereof. In addition, each of the two arms 50 is provided at the top end thereof with a pivoting portion 55. The two arms 50 are attached to the guide rod 40 by means of insertion slots 52. Two fastening members 56 of U-shaped construction are used to hold securely the guide rod 40 and the two arms 50. Each of the two fastening members 56 has two free ends, which are received securely in the through holes 54 of the insertion slots 52 by means of fastening buttons 57. The interval between the two arms 50 can be adjusted in accordance with the size of the game racket frame intended to be strung. The two clamping members 58 are mounted respectively on the two pivoting portions 55 of the two arms 50 for use in holding the game racket frame intended to be strung.

The string-pulling gear 60 is mounted on the machine body 22 and composed of a rotatable wheel 70, two string-holding members 80 and 82, an elastic element 90, a tension rod 92, and a weight 94.

The rotatable wheel 70 is provided with a through hole 72, and a threaded hole 74. The through hole 72 is provided with a cavity 76 located at the circumferential edge thereof and with a fitting hole 78 located at the circumferential surface thereof.

Each of the two string-holding members 80 and 82 has an arcuate circumferential surface and a straight arresting face 84 which is slightly serrated (not shown in the drawings). The circumferential surface of each of the two string-holding members 80 and 82 is provided with a string groove 85. In addition, each of the two string-holding members 80 and 82 is provided on the end surface thereof with a through hole 86. The string-holding member 80 is provided at the circumferential edge of the through hole 86 with a cavity 87. The string-holding member 80 is pivoted to the rotatable wheel 70 by means of a pivoting member 88 engageable with the through hole 86 of the string-holding member 80 and the through hole 72 of the rotatable wheel 70. In addition, the rotatable wheel 70 is pivoted to a seat 38 of the base 30. The seat 38 is provided with two stopping portions 39 serving as terminal points of the rotating of the rotatable wheel 70. The string-holding member 82 is pivoted to the rotatable wheel 70 by means of a screw 89 which engages the through hole 91 of the string-holding member 82 and the threaded hole 74 of the rotatable wheel 70. The string-holding members 80 and 82 are so disposed that their arresting faces 84 are opposite to each other.

The elastic element 90 of tubular construction is disposed between the rotatable wheel 70 and the string-holding member 80, with its both ends being received respectively in the cavities 76 and 87. The elastic element 90 is used to provide the string-holding member 80 with a bouncing force enabling the string-holding member 80 to move back to a specified position. As a result, the string-holding member 80 is located at a specified angular position in the absence of an external force exerting on the string-holding member 80. When the string-holding member 80 is located at such a specified angular position, the two arresting faces 84 of the two string-holding members 80 and 82 are kept apart at a predetermined interval.

The tension rod 92 is provided thereon with the pound marks indicating the intensity of the tension. The tension rod 92 is fitted securely into the fitting hole 78 of the rotatable wheel 70.

The weight 94 has an axial hole 96 which is so dimensioned to fit securely over the tension rod 92. A rotatable button 97 is secured to the weight 94 for use in adjusting the intensity of the tension that is expected to act on the string.

In operation, a game racket to be strung is first held securely by means of the two clamping members 58 of the stringing machine 20 of the present invention. The details of such an operational procedure are beyond the scope of this claimed invention and will not be therefore described here.

Figure 1:
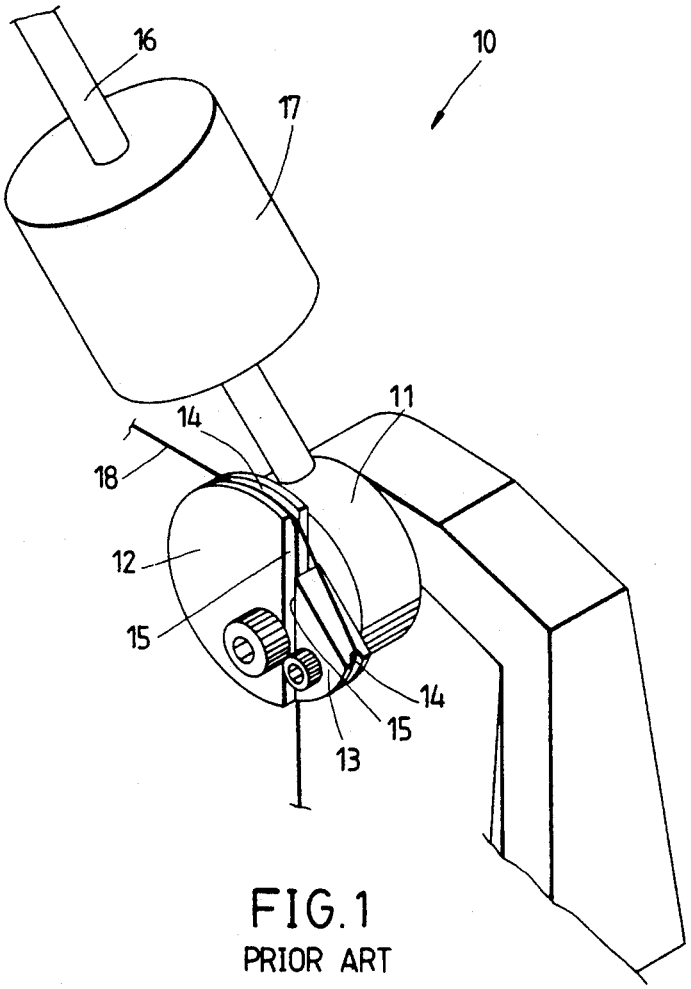
FIG. 1 PRIOR ART
FIG. 1 shows a perspective view of a game racket stringing machine of the prior art.
Figure 2:
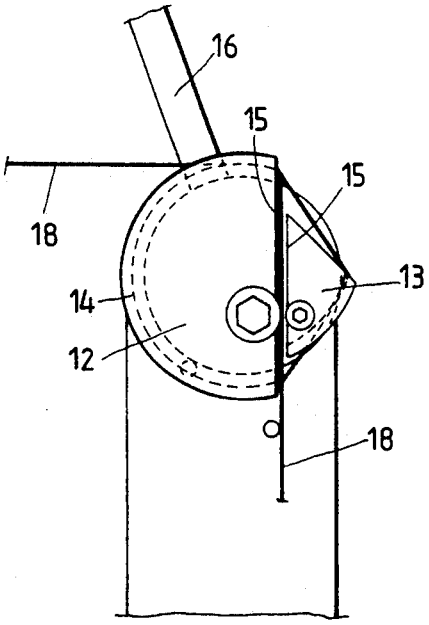
FIG. 2 PRIOR ART
FIGS. 2-5 are schematic views of the stringing machine at work, according to the prior art as shown in FIG. 1.
Figure 3:
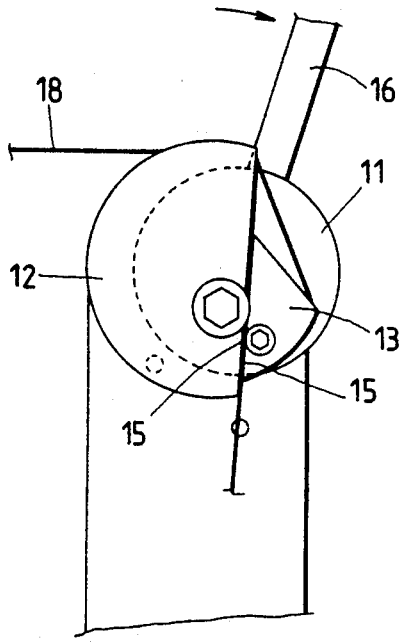
FIG. 3 PRIOR ART
Figure 4:
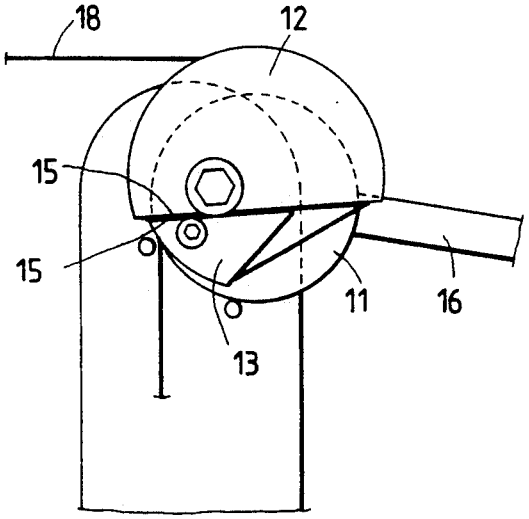
FIG. 4 PRIOR ART
Figure 5:
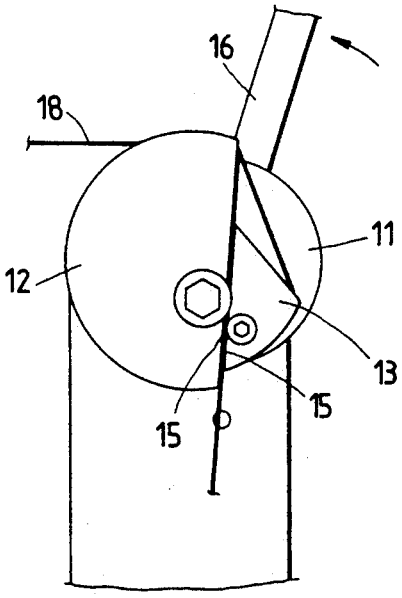
FIG. 5 PRIOR ART
Figure 8:
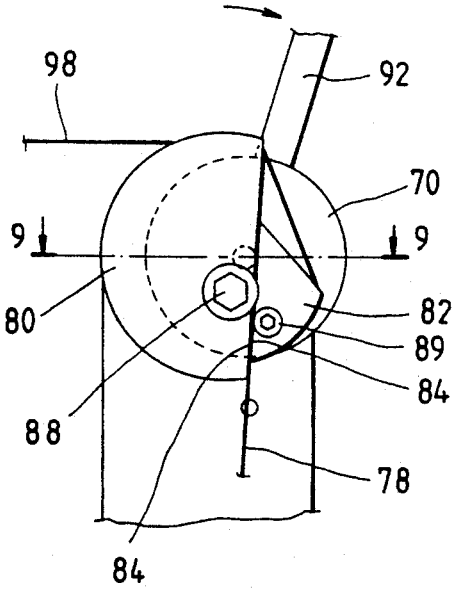
FIG. 8 is a schematic view showing that the two string-holding members of the string-pulling gear are in a state of holding the string securely, according to the present invention.
Figure 9:
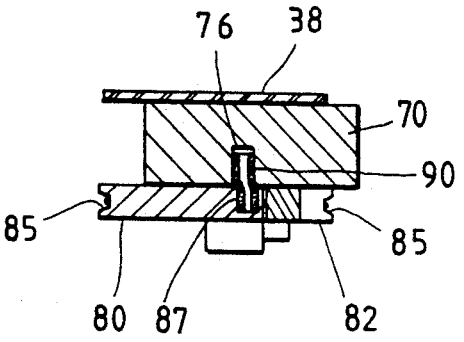
FIG. 9 is a sectional view, which is taken along the line 9—9 as shown in FIG. 8 and which shows the deformation of an elastic element that is acted on by a force.
Figure 10:
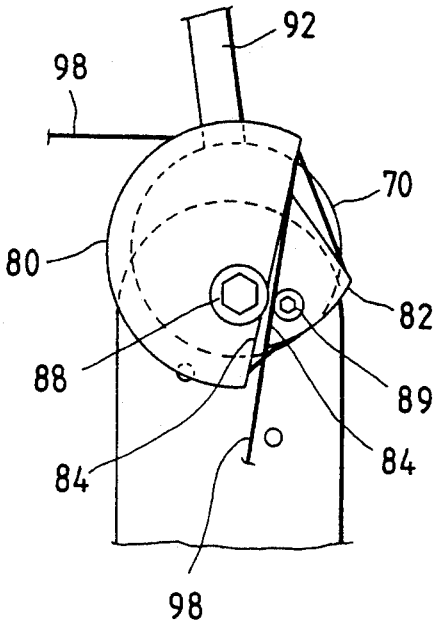
FIG. 10 is a schematic view showing that the two string-holding members release automatically the string at such time when the tension rod is pulled in reverse so as to permit the rewinding of the string on the string-holding members, according to the present invention.

The string 98 is first put through the string hole of the game racket frame and is then pulled to wind once in the string grooves 85 of the string-holding members 80 and 82 of the string-pulling gear 60. Thereafter, the string 98 is disposed between the two arresting faces 84 of the string-groove holding members 80 and 82. Such maneuvers as described above are similar to those of the prior art as illustrated in FIG. 2. The machine operator then uses one hand to hold the string 98 and another hand to pull the tension rod 92 so as to trigger the rotation of the rotatable wheel 70. At the outset of the rotating of the rotatable wheel 70, the string-holding members 80 and 82 will not turn synchronously in view of the fact that the string-holding members 80 and 82 are acted on by a reactional force of the string 98. As a result, the string-holding members 80 and 82 bring about an angular displacement in relation to the rotatable wheel 70, as shown in FIG. 8. The string-holding member 80 causes the elastic element 90 to deform, as shown in FIG. 9. Even though the string-holding members 80 and 82 are not triggered to turn at this moment, the angular positions of the pivoting points of the string-holding members 80 and 82 have shifted by virtue of the rotation of the rotatable wheel 70, as shown in FIG. 8. Therefore, the arresting faces 84 of the string-holding members 80 and 82 are caused to move so close together that they hold securely the string 98, thereby causing the string-holding members 80 and 82 to refrain from being displaced angularly. As a result, the rotatable wheel 70 is now able to cause a synchronous rotation of the string-holding members 80 and 82, thereby tightening the string 98.

As soon as the tension acting on the string 98 is canceled out by the gravitational moment formed by the weight 94, the tension rod 92 is located at a terminal position. If the terminal position of the tension rod 92 is within the range of 5 degrees over and under a horizontal line, the intensity of the tension acting on the string 98 is in agreement with a specified value. On the other hand, if the terminal position of the tension rod 92 is not within the range of 5 degrees over and under the horizontal line, the intensity of the tension acting on the string 98 is divergent from the specified value. As a result, the string 98 must be rewound on the string-holding members 80 and 82. The work of rewinding the string 98 on the string-holding members 80 and 82 can be done by pushing back the tension rod 92 so as to cause the rotatable wheel 70 and the string-holding members 80 and 82 to turn in reverse, thereby resulting in a reduction in the intensity of the tension acting on the string 98. At this moment, the bouncing force of the deformed elastic element 90 causes the string-holding member 80 to move in a clockwise direction to return to its original position. Such a clockwise angular displacement of the string-holding member 80 triggers a similar angular displacement of another string-holding member 82. As a result, the arresting faces 84 of the two string-holding members 80 and 82 are kept so apart that they no longer hold securely the string 98. The release of the string 98 by the arresting faces 84 permits the machine operator to readjust manually the rewinding of the string 98 on the string-holding members 80 and 82 so that the intensity of the tension acting on the string 98 in the course of stringing the game racket frame is in compliance with the specified value.

Figure 11:
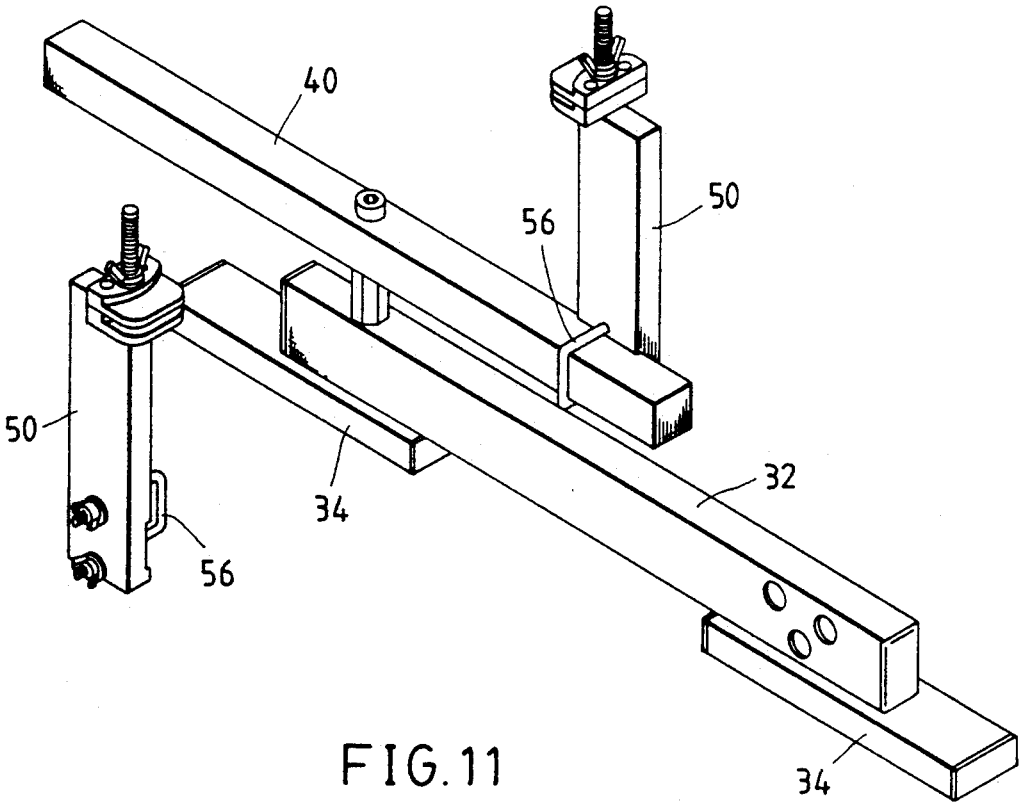
FIG. 11 is a perspective view showing that the components of the machine body of the present invention have been so rearranged that the machine body can be easily packed, transported, and stored.

As shown in FIG. 6, when the stringing machine 20 of the present invention is at work, the secondary rods 34 and the main rod 32 are joined together, forming right angles. The secondary rods 34 can not be turned at will so as to ensure the stability of the base 30 when the stringing machine 20 is in action. However, the secondary rods 34 can be turned around forcibly to be parallel to and overlapped with the main rod 32, as shown in FIG. 11. In addition, the tension rod 92 and the two arms 50 can be so removed that the volume of the machine body 22 is reduced to allow the stringing machine 20 to be packed, transported, and stored easily.

The stringing machine 20 of the present invention has advantages over the prior art stringing machine, which are described hereinafter.

The stringing machine 20 of the present invention is provided with the elastic element 90, which is disposed between the rotatable wheel 70 and the string-holding member 80. The elastic element 90 affords a bouncing force enabling the string-holding members 80 and 82 to release automatically the string 98 which has to be rewound on the string-holding members 80 and 82. Therefore, the machine operator can readjust easily the rewinding of the string 98 without having to turn the string-holding members 80 and 82.

The machine body 22 of the stringing machine 20 of the present invention can be reduced in volume when the stringing machine 20 is not at work. Therefore, the stringing machine 20 of the present invention can be easily packed, transported, and stored.

The embodiment of the present invention described above is to be regarded in all respects as illustrative and not restrictive. Accordingly, the present invention may be embodied in other specific forms without deviating from the spirit thereof. The present invention is therefore to be limited only by the scope of the following appended claims.

What is claimed is:

1. A machine for stringing a game racket comprising a machine body and a string-pulling gear; wherein said string-pulling gear comprises:

a rotatable wheel mounted on said machine body;

two string-holding members, each of which has an arresting face and a circumferential surface connecting with said arresting face and having thereon a string groove, said two string-holding members being pivoted to a free end of said rotatable wheel in such a manner that said two string-holding members can be caused to rotate respectively on pivoting points of said two string-holding members, with said pivoting points serving as fulcrums, said two string-holding members capable of being caused by an external force to displace angularly so as to cause arresting faces of said two string-holding members to stay close together;

a tension rod fastened to said rotatable wheel such that said rotatable wheel can be caused by said tension rod to rotate; and a weight fastened to said tension rod;

wherein said string-pulling gear is characterized in that said string-pulling gear further comprises an elastic element capable of providing said two string-holding members with a bouncing force enabling said two string-holding members to move back to a specified angular position.

2. The machine according to claim 1 wherein said rotatable wheel and said string-holding members are provided respectively and correspondingly with a cavity; and wherein said elastic element is of tubular construction and has two ends that are received in said cavity of said rotatable wheel and in said cavity of said string-holding members.

3. The machine according to claim 1 comprises at least one elastic element disposed between said rotatable wheel and one of said two string-holding members such that another one of said two string-holding members is urged by said elastic element at such time when said one of said two string-holding member moves back to a specified position.

4. The machine according to claim 1 wherein said machine body comprises:

a base having a main rod and two secondary rods which are pivoted respectively to the undersides of both ends of said main rod;

a guide rod pivoted to said main rod;

two arms mounted on said guide rod such that each of said two arms can slide along an axis of said guide rod; and two clamping members mounted respectively on the top ends of said two arms.

5. A machine for stringing a game racket comprising a machine body and a string-pulling gear mounted on said machine body; wherein said machine body comprises:

a base;

a guide rod pivoted to said base;

two arms mounted on said guide rod such that each of said two arms can slide along an axis of said guide rod; and two clamping members mounted respectively on said two arms for holding securely a game racket frame intended to be strung;

wherein said machine body is characterized in that said base of said machine body comprises a main rod and two secondary rods which are pivotable respectively to the undersides of two ends of said main rod.

6. The machine according to claim 5 wherein each of said two arms is provided with an insertion slot to receive therein said guide rod, and with two fastening members of U-shaped construction and having two ends, each of which is provided with a fastening button for fastening said arms to said guide rod.

* * * * *